US012644210B2

(12) United States Patent
Dermody, IV et al.

(10) Patent No.: US 12,644,210 B2
(45) Date of Patent: Jun. 2, 2026

(54) ASSEMBLY WITH INTEGRAL DIGITAL IDENTIFICATION ENCODING

(71) Applicant: Techflex Inc., Sparta, NJ (US)

(72) Inventors: William Dermody, IV, Sparta, NJ (US); William Squier, Sparta, NJ (US); Matthew Mercier, Windermere, FL (US)

(73) Assignee: TECHFLEX INC., Sparta, NJ (US)

( * ) Notice: Subject to any disclaimer, the term of this patent is extended or adjusted under 35 U.S.C. 154(b) by 0 days.

(21) Appl. No.: 18/596,719

(22) Filed: Mar. 6, 2024

(65) Prior Publication Data

US 2024/0301599 A1 Sep. 12, 2024

Related U.S. Application Data

(60) Provisional application No. 63/489,277, filed on Mar. 9, 2023.

(51) Int. Cl.
*D04C 1/12* (2006.01)
*D04C 3/40* (2006.01)

(52) U.S. Cl.
CPC ..... *D04C 1/12* (2013.01); *D04C 3/40* (2013.01)

(58) Field of Classification Search
CPC ..... D04C 1/12; D04C 3/40
USPC ..... 138/104
See application file for complete search history.

(56) References Cited

U.S. PATENT DOCUMENTS

| | | | | |
|---|---|---|---|---|
| 8,689,836 | B2 | 4/2014 | Hudson | |
| 9,038,670 | B2 | 5/2015 | Vinoy | |
| 9,470,352 | B2 | 10/2016 | Schooley et al. | |
| 9,759,349 | B2 | 9/2017 | Nyfelt | |
| 10,227,829 | B2 | 3/2019 | Drevdal et al. | |
| 11,099,296 | B2 | 8/2021 | Palomares | |
| 11,681,892 | B2 | 6/2023 | Schmidt et al. | |
| 2016/0243648 | A1 | 8/2016 | Sigler Poveda et al. | |
| 2019/0120416 | A1 | 4/2019 | Wind et al. | |
| 2019/0276982 | A1 | 9/2019 | Plaia | |
| 2021/0357720 | A1* | 11/2021 | Schmidt | F16L 11/124 |
| 2022/0221095 | A1 | 7/2022 | Nutt et al. | |

FOREIGN PATENT DOCUMENTS

| | | | |
|---|---|---|---|
| EP | 2395458 | A1 | 12/2011 |
| EP | 3522138 | A1 | 8/2019 |
| EP | 4113359 | A1 | 1/2023 |
| EP | 4113360 | A1 | 1/2023 |
| WO | 2014204765 | A1 | 12/2014 |
| WO | 2019175509 | A1 | 9/2019 |
| WO | 2023274455 | A1 | 1/2023 |

* cited by examiner

*Primary Examiner* — David R Deal
(74) *Attorney, Agent, or Firm* — Kelly G. Swartz; Widerman Malek, PL

(57) ABSTRACT

The invention is a trackable protective sleeving, which include a filament, a digital identifier secured to the filament, and a hollow structure carrying the filament. The hollow structure may include a plurality of braided fibers, woven fibers, or knit fibers. The hollow structure may be extruded. In one embodiment, the filament and the plurality of fibers may be arranged in a braided configuration formatting a tube with a central void.

11 Claims, 7 Drawing Sheets

ASSEMBLY WITH INTEGRAL DIGITAL IDENTIFICATION ENCODING

RELATED APPLICATIONS

This application claims priority under 35 U.S.C. § 119(e) of U.S. Provisional Patent Application Ser. No. 63/489,277 filed on Mar. 9, 2023 and titled INTEGRATED IDENTIFICATION SLEEVING. The content of this application is incorporated herein by reference.

FIELD OF THE INVENTION

The following disclosure relates generally to tubing and sleeving products, and, more specifically, to Radio Frequency Identification (RFID) compatible tubing and sleeving products.

BACKGROUND OF THE INVENTION

Protective sleeving, hose, tubing, and lacing tape products are frequently used in performance critical assemblies. To ensure the expected performance, it may be useful for the installer or maintenance personnel to know some information about the sleeving, hose, tubing, or lacing tape materials. Information that may be desirable to know may include: date of manufacture, material composition, date of installation, contents of the assembly, expiration date, manufacturer identity, purchase order number, lot number, serial number, part number, regulatory compliance identifiers, acceptable thermal range, as well as other information that may be specific to certain applications or users.

Known methods to provide this information on protective sleeving, hose, tubing, and lacing tape products include visible human readable print directly on the material and hang tags attached to the material. These methods, while functional, are not always durable or easily visible after the wear and tear incurred during time in the field. In some cases, the protective sleeving, hose, tubing, or lacing tape material is too small for practical applications of printed text or symbols. It may also be difficult to access the particular material of interest if it is included in a bundle of other materials. These known printing or post manufacture tagging methods may also be subject to counterfeiting by entities other than the manufacturer. The original manufacturer of the protective sleeving, hose, tubing, or lacing tape material has a vested interest in ensuring the materials used in a performance critical application are legitimately sourced from the manufacturer. Warranties and other contractual obligations may depend on properly identifying the source of the protective sleeving, hose, tubing, or lacing tape materials.

Unique identification of protective sleeving, hose, tubing, and lacing tape products and components is critical to the successful utilization and maintenance of those products and components. For instance, having such information available can help to identify defective batches or groups of products, which allows remaining inventory to be tested before release and released inventory to be identified and, if needed, recalled. Such information may also help to determine expiration dates, reduce human error (e.g. by providing confirmation that the selected product is the intended one), allow for enhanced automation, identify components incorporated into larger assemblies, and provide other benefits.

Currently, tracking of unique identifiers, which is usually referred to as lot tracking, is accomplished by physically marking the product. For products below a certain, threshold size, such as filament or thread, which may be incorporated into another product, such as braided sleeving, physical markings become impractical. Additionally, for products that may be incorporated into other products through operations that result in a state change, such as the incorporation of a filament into tubing involving a transition to a molten state and subsequent freezing of the material into a new shape (e.g., through an extrusion process), physical markings are ineffective because the physical markings would be removed during the state transition.

While separate storage of batches would allow for lot tracking of such products initially, it would not allow for further tracking once sold, unless such products were kept separate by the customer. Such lot tracking is very expensive, however, and would not be practical for most situations.

Therefore, what is needed is a cost-effective way of uniquely and readily identifying products using non-destructive means of testing that would allow the identification of very small products as well as those that may be incorporated into other products following a state change, preferably using only commercially available tools.

Patent Application US 2019/0276982 A13 discloses an application embedding information into rope that relies on "a carrying structure and a plurality of RFID systems supported by the carrying structure." However, this patent application does not disclose a solution for embedding information in extruded materials.

Patent EP3910219A14 discloses an application for embedding an RFID into an extruded hose.

Patent WO2019175509A15 discloses a string of RFID chips "encapsulated by a protective material."

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a trackable protective sleeving including a filament, a digital identifier secured to the filament, and a hollow structure carrying the filament.

The hollow structure may include a plurality of braided, woven, or knitted fibers. The plurality of braided fibers may include the filament itself and they may be arranged in a biaxial braid. The plurality of braided fibers may include the filament itself and they may be arranged in a triaxial braid.

The trackable protective sleeving may include an adhesive securing the filament to at least one of the other of the plurality of braided fibers.

The filament may be secured to an exterior surface of the hollow structure on either an inner or outer diameter.

The filament and the digital identifier secured to the filament may be encased in a polymer.

The hollow structure may be created using a method of extrusion.

An adhesive may be positioned on an exterior surface of the hollow structure to carry the filament. The exterior surface may be on either an inner or outer diameter.

The digital identifier may include an antenna.

The hollow structure may have a hollow interior adapted to carry an electrically conductive material within the hollow interior.

The hollow structure may have a hollow interior adapted to carry a fluid within the hollow interior.

One embodiment of the trackable protective sleeving may include a filament, a digital identifier secured to the filament, and a plurality of fibers. The filament and the plurality of fibers may be arranged in a braided configuration forming a tube with a central void.

The braided configuration may be a biaxial braid.

The braided configuration may be a triaxial braid.

The trackable protective sleeving may include an adhesive securing the filament to at least one of the plurality of fibers.

The filament and digital identifier may be encased in a polymer.

One embodiment of the trackable protective sleeving may include a filament, a digital identifier secured to the filament, and an extruded hollow structure carrying the filament.

The filament and the digital identifier may be incorporated in the extruded hollow structure to form a monolithic unit.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
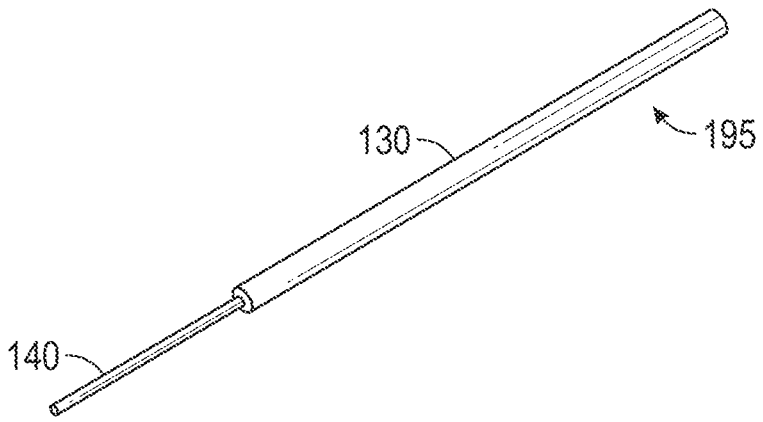
FIG. 1 is a perspective view of a trackable filament partially encased in a polymer exterior according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

The need to embed some identifying information into a protective sleeving exists. By way of example, but not as a limitation the term protective sleeving may include hose, tubing, braided sleeves, lacing tape, or the like. Embedding identifying information into protective sleeving may be accomplished by creating a novel trackable protective sleeving 100 with the inherent and durable ability to provide identifying information as described herein. The identifying information of such a trackable protective sleeving 100 product may be accessed anytime by scanning the product 100 with an appropriate scanning tool such as, by way of example, and not as a limitation, RFID reading equipment.

An embodiment of the invention, as shown and described by the various figures and accompanying text, provides a trackable protective sleeving 100 including at least one filament 110 carrying at least one digital identifier 120. One or more digital identifiers 120 may be carried by the filament 110 and the filament 110 may be encased by a polymer exterior 130. By way of example, and not as a limitation, the polymer may be plastic, rubber, or the like. The combination of the filament 110 carrying a digital identifier 120 may be referred to as a trackable filament 140. As depicted at least in FIG. 1, a trackable filament 140 may be encased in a polymer exterior 130. As depicted at least in FIG. 3, a trackable filament 140 may not be encased in a polymer exterior 130.

Figure 2:
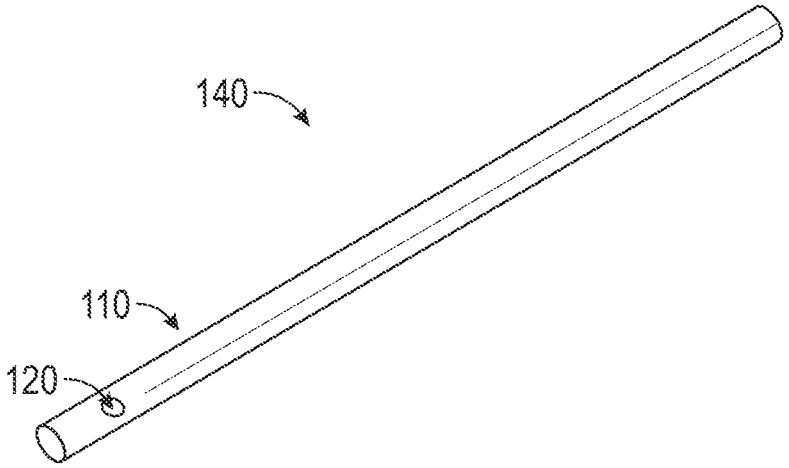
FIG. 2 is a perspective view of a trackable filament according to an embodiment of the present invention.

As depicted at least in FIG. 1, the digital identifier 120 may be integrated into and inseparable from the filament 110, forming an integral trackable filament 140. In an embodiment depicted at least in FIG. 2, the digital identifier 120 may be separable from the filament 110. In such an embodiment, the digital identifier 120 may be adhered to the filament 110. The combination of the digital identifier 120 and the filament as depicted in FIG. 2 may also be included in the definition of a trackable filament 140.

In one embodiment, the digital identifier 120 may, by way of example, and not as a limitation, be an RFID tag or the like. In embodiments in which the digital identifier 120 is an RFID tag, the trackable protective sleeving 100 may further include a coil configured to be energized by commercially available RFID reading equipment. In such an embodiment, the coil may be configured to power the RFID tag.

Each trackable filament 140 may include a single filament 110 and a plurality of digital identifiers 120.

In one embodiment, by way of example, and not as a limitation, the filament 110 may include a long thread or similar elongate member.

The trackable protective sleeving 100 may be scanned with commercially available RFID reading equipment. The RFID reading equipment may detect the digital identifier 120 and provide information to a user related to the trackable protective sleeving 100. Information that may be encoded in the digital identifier 120 may include, but is not limited to, expiration date, manufacturer, production date, or the like. This information may be utilized to facilitate lot tracking. Lot tracking is an important inventory management process that helps businesses trace products, most commonly by expiration date, manufacturer, or production date, to comply with regulations and to act promptly in case of a recall. Lot tracking also helps ecommerce businesses keep inventory organized to make sure particular batches of products are utilized in a particular order.

Figure 5:
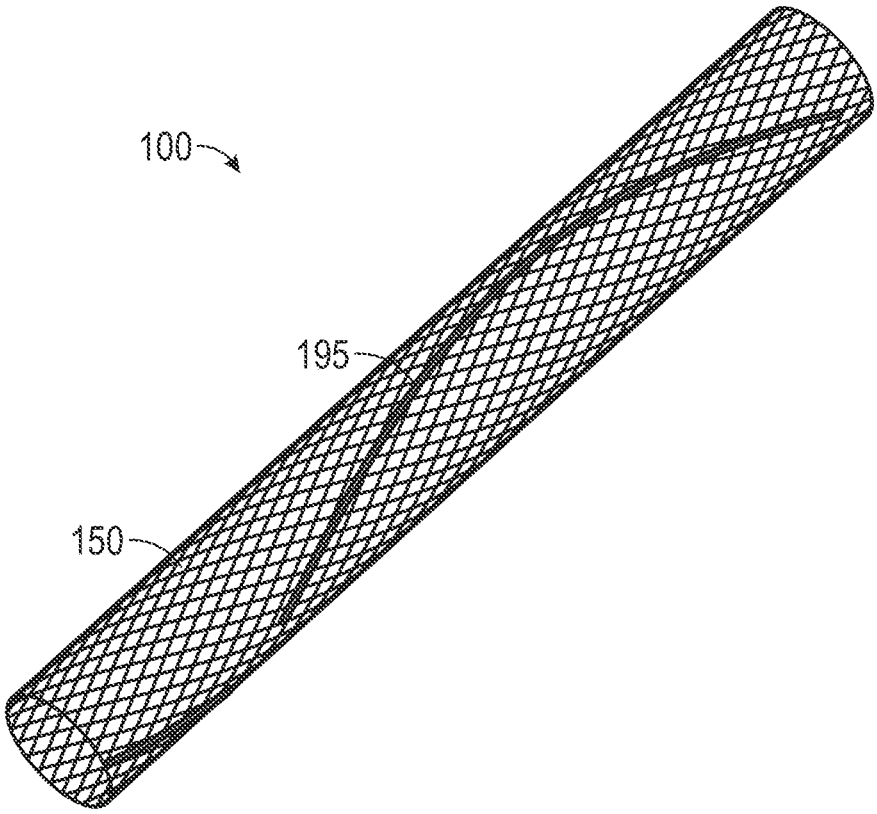
FIG. 5 is a perspective view of a trackable protective sleeving according to another embodiment of the present invention.

As depicted at least in FIG. 5, one or more of the trackable filaments 140 or polymer encased trackable filaments 195 may be woven, biaxial braided, triaxial braided, or knit with a plurality of other filaments to form the trackable protective sleeving 100. As depicted in FIG. 5, the trackable protective sleeving may be a braided sleeve 150. One or more of the trackable filaments 140 or polymer encased trackable filaments 195 may be introduced to a braided construction with a plurality or other filaments to form the braided sleeve 150.

Figure 6:
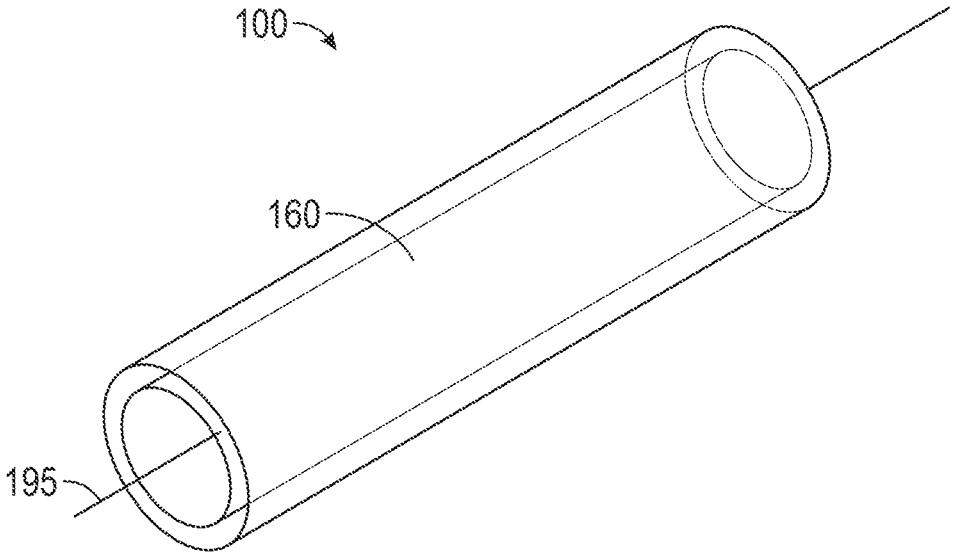
FIG. 6 is a perspective view of a trackable protective sleeving according to yet another embodiment of the present invention.

In another embodiment, as depicted at least in FIG. 6, one or more trackable filaments 140 or polymer encased trackable filaments 195 may be utilized in an extrusion process and may form one or more layers of an extruded material 160. The resulting trackable protective sleeving 100 may be a tube. By way of example, and not as a limitation, the trackable filament 140 or polymer encased trackable filament 195 may be adhered to the surface of tubing 160 or may be extruded with the material forming the tubing 160. In one embodiment, the trackable filament 140 or polymer encased trackable filament 195 may be fused with a surrounding portion of the tubing 160 to form a unitary structure.

Figure 4:
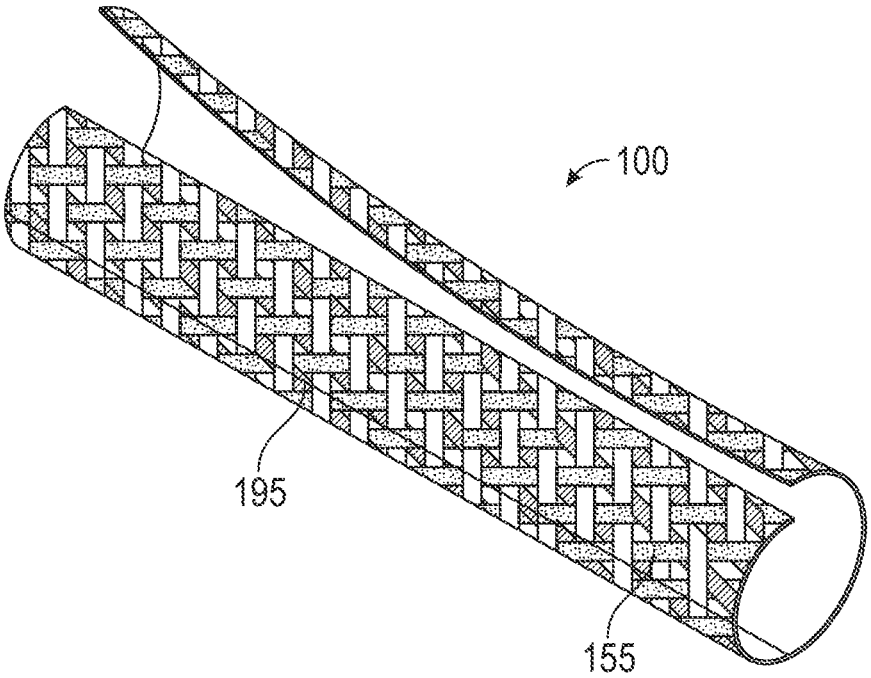
FIG. 4 is a perspective view of a trackable protective split sleeving according to an embodiment of the present invention.

In another embodiment, as depicted at least in FIG. 4, the trackable filament 140 or polymer encased trackable filament 195 may be included with a split sleeving 155. In such an embodiment, the split sleeving may be woven, biaxial braided, triaxial braided, or knit.

This unique combination of digital identifiers 120 integrated into filaments 110 and incorporated into protective sleeving, including, but not limited to, extruded hoses, tubing, braided material, or the like offers a tracking solution for industries that rely on the performance of these materials to maintain the safety and effectiveness of assemblies. Using proprietary or commercially available scanner technologies the encoded characteristics of the material can be stored in the digital identifier 120 and may be verified at any point in the supply chain or in field installations.

Trackable protective sleeving 100 products may be braided, woven, knitted, coated or extruded. Construction incorporating the trackable filament 140 or polymer encased trackable filament 195 as part of a trackable protective sleeving 100 provides for individual identification of each trackable filament 140 and trackable protective sleeving 100 products 100 constructed therewith. These sleeving products may be constructed from any combination of braid, weave, knit, or extrusion. For each of these methods of construction, the sleeving product may be any pattern. Using any of these construction methods and patterns, the sleeving product may be split, as depicted at least in FIG. 4 or a tube, as depicted at least in FIG. 5.

A filament 110 carrying at least one digital identifier 120 that may be suitable for this application may be commercially available from a number of suppliers. By way of example, and not as a limitation, the digital identifier 120 may include a magnetically, digitally encoded fiber. In such an embodiment, the digital identifier 120 may be inseparable from the filament 110 itself and the combination may be referred to as a trackable filament 140. Such a trackable filament 140 may be included in a braided construction or introduced into an extruded hose, tube, or braided material just as any other constructed trackable filament 140 may be.

Figure 3:
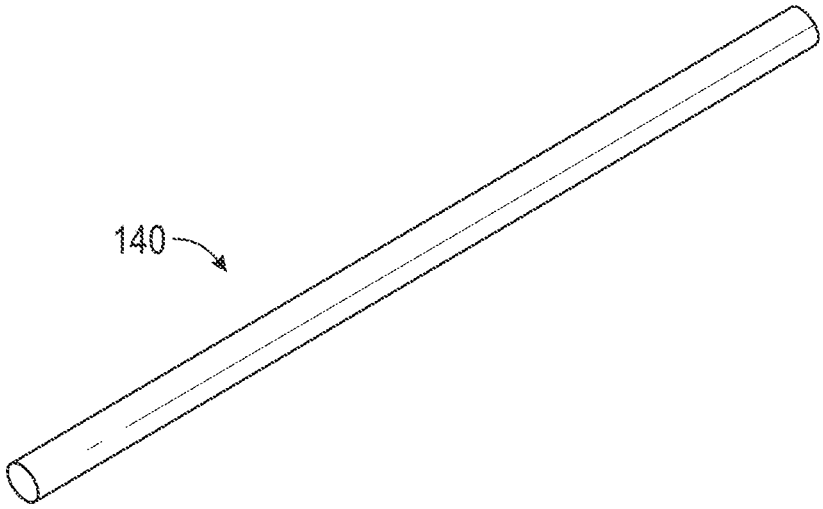
FIG. 3 is a perspective view of the trackable filament of FIG. 2.

At least FIGS. 1, 2, and 3 depict a trackable filament 140 that may be interrogated by and may be configured to provide information that uniquely identifies the trackable filament 140 to commercially available RFID reading equipment. By way of example, and not as a limitation, the information may include lot number, production date, material type, expiration date, SKU, or the like. Additional information may also be encoded by the digital identifier, by way of example, and not as a limitation, either in plaintext or in an encrypted or abbreviated form, as would be known to one of ordinary skill in the art. As depicted in FIG. 1, the trackable filament may be surrounded by a polymer exterior 130 to create a polymer encased trackable filament 195.

The trackable filament 140 or polymer encased trackable filament 195 may be braided, woven, or knit with other filaments or similar elongate members. In such an embodiment, as depicted at least in FIGS. 4 and 5, the trackable protective sleeving 100 may include the resulting braided sleeve 150 or split sleeving 155.

The trackable protective sleeving 100 may be configured to encase electrically conductive components or carry fluids.

Trackable filaments 140 or polymer encased trackable filaments 195 suitable for the trackable protective sleeving 100 may be available from a number of suppliers. By way of example and not as a limitation, Primo1D™ offers an RFID encoded thread, which may be utilized as trackable filament 140. In one embodiment, the trackable filament 140 may include two conductive strands of an antenna connected to each RFID chip carried by the trackable filament 140. Trackable filament 140 provided by Primo1D may be utilized as a thread in a braided material or introduced into an extruded hose, tube, or woven fiber. Similarly, these trackable filaments 140 may be utilized by the extrusion process disclosed herein to create polymer encased trackable filaments 195.

Figure 7:
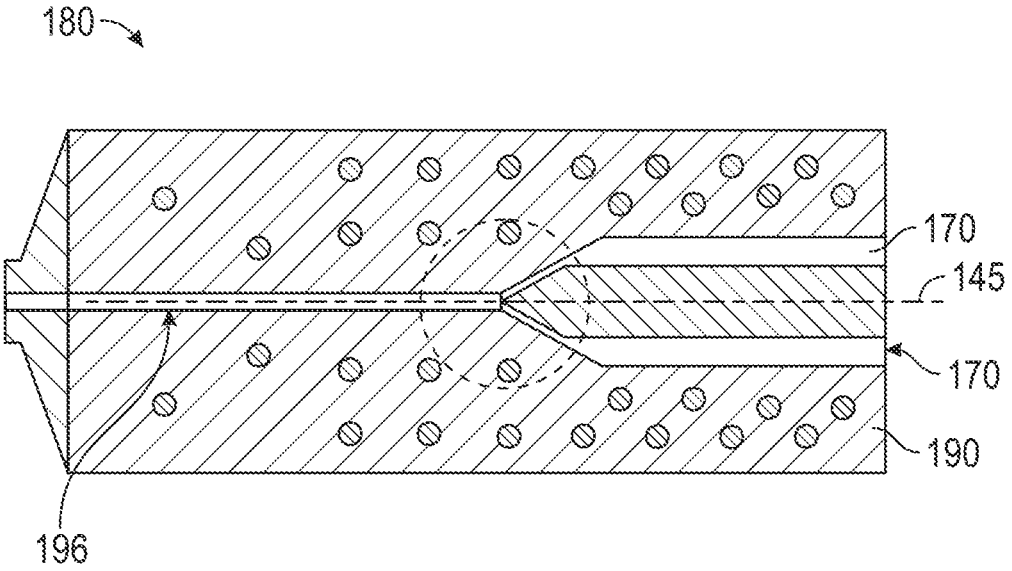
FIG. 7 is a cross section of an extrusion die used in a method of extruding the polymer encased trackable filament according to an embodiment of the present invention.
Figure 8:
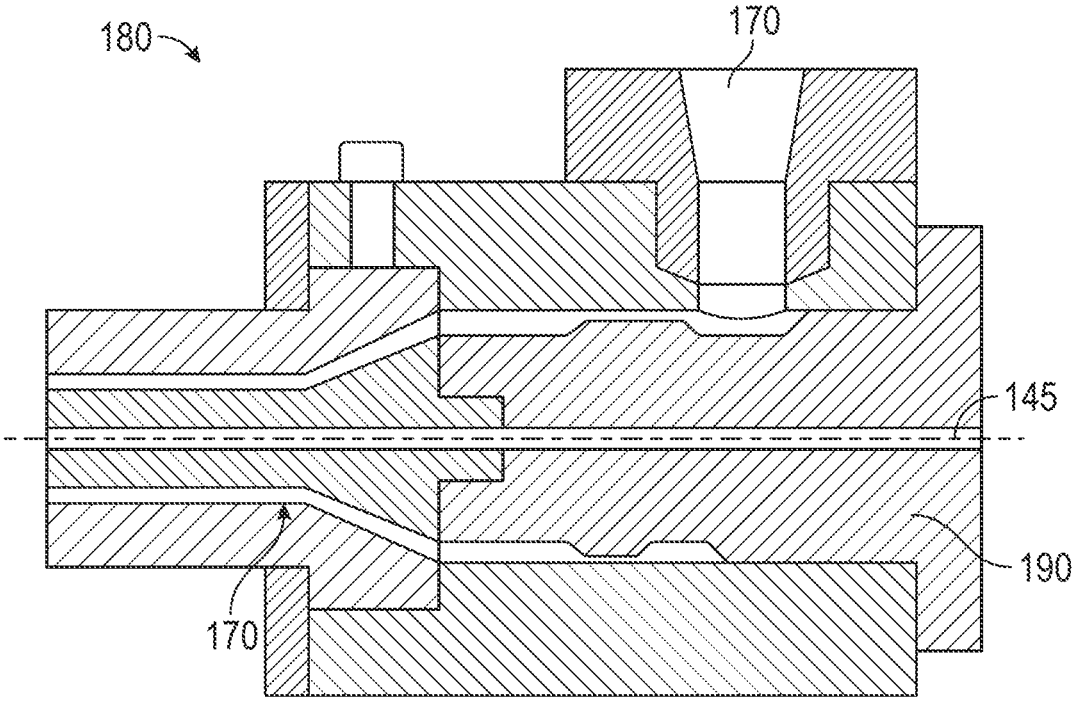
FIG. 8 is a detail of area A of FIG. 5.
Figure 13:
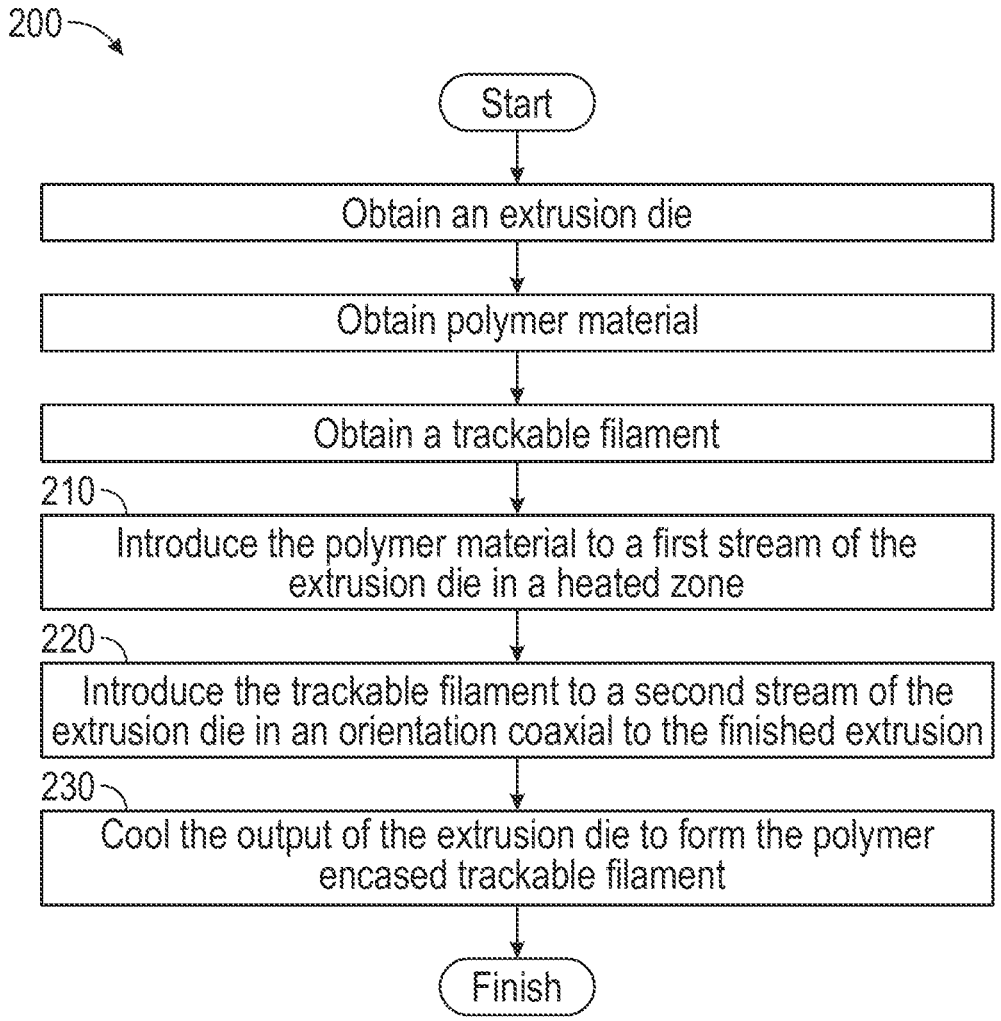
FIG. 13 is a flow chart of a method for extrusion.

One embodiment of the trackable protective sleeving 100 may be constructed by encapsulating a trackable filament 140 by extruding polymer material 130 over the thread. This may be accomplished by feeding the trackable filament 140 into a crosshead extruder, such as the one depicted in FIG. 7, that extrudes melted polymer material using a specially configured crosshead extrusion process 200 as depicted in the flowchart of FIG. 13. The crosshead extrusion process 200 may include the step of introducing polymer material melt to a first channel 170 of the extrusion die 180 (Step 210), as depicted in FIG. 7. The trackable filament 140 may be introduced to a second channel 145 of the extrusion die 180 (Step 220), as also depicted in FIG. 7. In such a method, the polymer material melt may be introduced to the extrusion die 180 from a heated zone 190 and the trackable filament 140 may be introduced to the extrusion die 180 in an orientation coaxial to the finished extrusion. The finished, extruded polymer encased trackable filament 195 may exit the extrusion die 180 from a third channel 196 and be cooled (Step 230). The result of this process 200 may be a polymer encased trackable filament 195 that may be woven into a variety of braided sleeving products using various weaving processes. The weaving processes may be provided by a sleeve braiding machine. By way of example, and not as a limitation, these braided sleeves may be referred to as expandable sleeving, braided sleeving, self-wrapping sleeving, or composite sleeving comprised of several layers of material. By way of example, and not as a limitation, another possible result of the extrusion process 200 may be tubing 160 with the trackable filament 140 encapsulated in a wall of the tubing 160, as depicted at least in FIG. 6.

Figure 9:
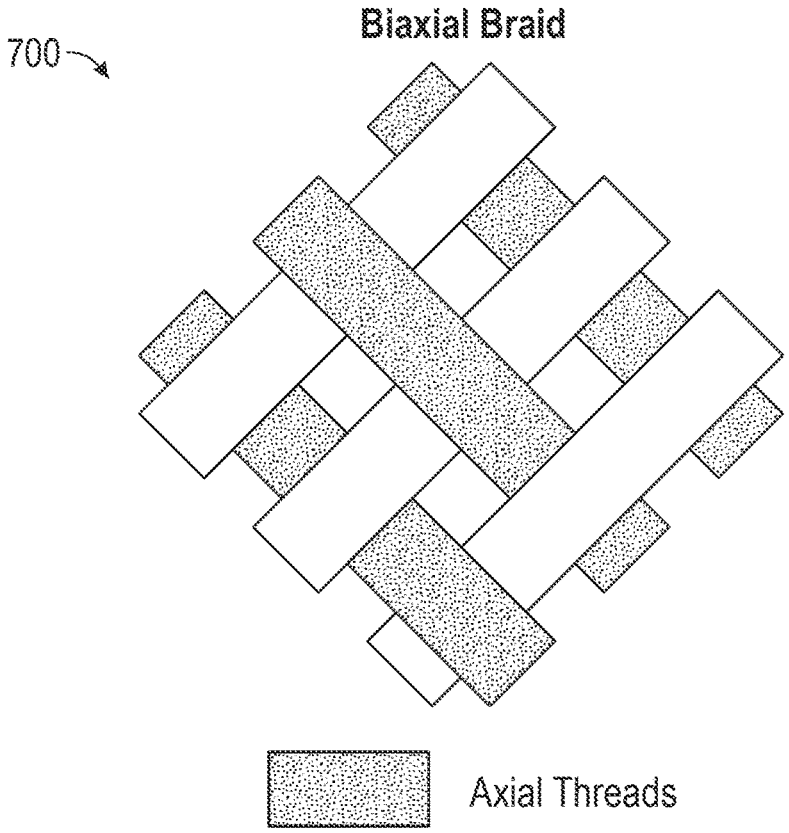
FIG. 9 depicts a biaxial braid pattern according to one embodiment of the present invention.
Figure 10:
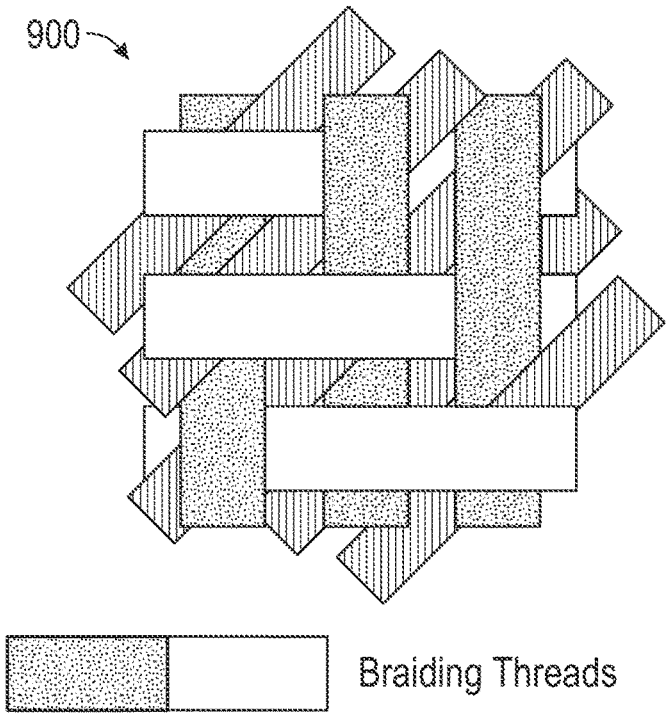
FIG. 10 depicts a woven pattern according to one embodiment of the present invention.
Figure 11:
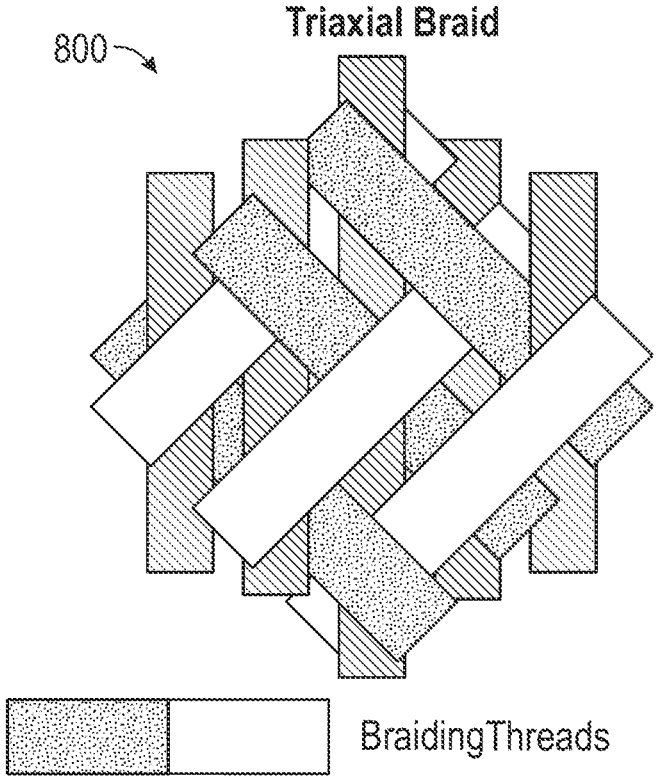
FIG. 11 depicts a triaxial braid pattern according to one embodiment of the present invention.
Figure 12:
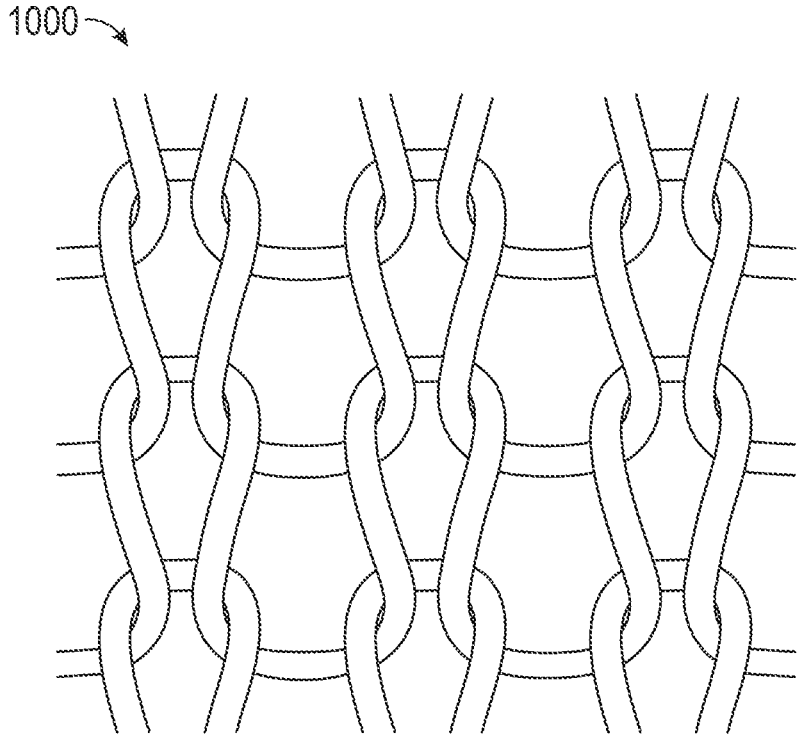
FIG. 12 depicts a knit pattern according to one embodiment of the present invention.

One embodiment of the trackable protective sleeving 100 may include braided sleeving 150 that is referred to as expandable or lacing tape. Such an embodiment may be constructed by directly weaving the trackable filament 140 or polymer encased trackable filament 195 into the braid 150 by including the trackable filament 140 or polymer encased trackable filament 195 as one of the bobbins on a braiding machine. In another embodiment, the trackable filament 140 or polymer encased trackable filament 195 may be braided with other fibers but not part of continuous strand of the braid. The finished construction may include the trackable filament 140 or polymer encased trackable filament 195 in a biaxial braid 700, as depicted in FIG. 9, in a triaxial braid, as depicted in FIG. 11, in a weave 900, as depicted in FIG. 10, or in a knit 1000, as depicted in FIG. 12. In any of these construction methods, the trackable filament 140 or polymer encased trackable filament 195 may be an integral part of the overall sleeving, as depicted in FIGS. 4 and 5.

Another embodiment of the trackable protective sleeving 100 may include braided sleeving 150 constructed by directly weaving the trackable filament 140 or polymer encased trackable filament 195 into the braided sleeve 150 by including the trackable filament 140 or polymer encased trackable filament 195 as one of the bobbins on a braiding machine. In another embodiment, the trackable filament 140 or polymer encased trackable filament 195 may be braided with other fibers but not part of a continuous strand of the braid. The finished construction may include the trackable filament 140 or polymer encased trackable filament 195 in a triaxial braid 800, as depicted in FIG. 11, a biaxial braid 700, as depicted in FIG. 11, a weave 900, as depicted in FIG. 10, or a knit 1000, as depicted in FIG. 12. Utilizing any method of construction, the trackable filament 140 or polymer encased trackable filament 195 may be an integral part of the overall sleeving, as depicted in FIGS. 4 and 5.

Yet another embodiment of the trackable protective sleeving 100 may include extruded tubing 160, as depicted at least in FIG. 6. In such an embodiment, the polymer exterior 130 and trackable filament 140 may be fed into a crosshead extruder that extrudes melted polymer using a specially configured extrusion process 200 as describe in FIG. 13. This crosshead extrusion process 200 may allow polymer material melt 170 to enter the extrusion die from one stream 170 and the trackable filament 140 to enter from another stream 140. The finished, extruded product may be cooled to form an extruded polymer tube 160 with a polymer exterior 130 and the trackable filament 140 encapsulated in the wall of the tubing, as depicted in FIG. 6.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A trackable protective sleeving comprising:

a filament;

a digital identifier secured to the filament; and a hollow structure carrying the filament, wherein the hollow structure is created by a crosshead extrusion process comprising introducing the filament coaxially to a finished extrusion orientation into an extrusion die while introducing polymer material melt from a heated zone into the extrusion die, such that the filament and the digital identifier are encapsulated within a wall of the hollow structure.

2. The system of claim 1 wherein the hollow structure includes a plurality of braided fibers.

3. The system of claim 2 further comprising an adhesive securing the filament to at least one of the other of the plurality of braided fibers.

4. The system of claim 1 wherein the hollow structure includes a plurality of woven fibers.

5. The system of claim 4 further comprising an adhesive securing the filament to at least one of the other of the plurality of woven fibers.

6. The system of claim 1 wherein the hollow structure includes a plurality of knit fibers.

7. The system of claim 1 wherein the filament and the digital identifier secured to the filament are encased in a polymer.

8. The system of claim 1 wherein the hollow structure has a hollow interior adapted to carry an electrically conductive material.

9. The system of claim 1 wherein the hollow structure has a hollow interior adapted to carry a fluid.

10. A trackable protective sleeving comprising:

a filament;

a digital identifier secured to the filament; and an extruded hollow structure carrying the filament;

wherein the extruded hollow structure is created by a crosshead extrusion process comprising introducing the filament coaxially to a finished extrusion orientation into an extrusion die while introducing polymer material melt from a heated zone into the extrusion die.

11. The system according to claim 10 wherein the filament and the digital identifier are incorporated in the extruded hollow structure to form a monolithic unit.

* * * * *